US005513823A

United States Patent [19]

Bresnahan

[11] Patent Number: 5,513,823

[45] Date of Patent: May 7, 1996

[54] PLASTIC BAG HOLDER

[76] Inventor: Jeremiah J. Bresnahan, 5741 College, St. Louis, Mo. 63136

[21] Appl. No.: 239,579

[22] Filed: May 9, 1994

[51] Int. Cl.[6] ..... B65B 67/04

[52] U.S. Cl. ..... 248/99; 211/106; 248/95; 403/103

[58] Field of Search ..... 248/95, 97, 99, 248/100, 101, 282; 211/96, 168, 106, 181; 403/92, 95, 103, 104, 108, 107, 372, 365, 282.1, 289.11

[56] References Cited

U.S. PATENT DOCUMENTS

| | | | |
|---|---|---|---|
| 3,329,385 | 7/1967 | Dietsch | 211/96 X |
| 3,890,672 | 6/1975 | Berthagen | 16/141 |
| 4,364,496 | 12/1982 | Bridgeman | 223/88 |
| 4,498,652 | 2/1985 | Malik | 248/99 |
| 4,579,307 | 4/1986 | Malik | 248/99 |
| 4,669,689 | 6/1987 | Jones | 248/99 |
| 4,672,898 | 6/1987 | Davidson | 108/6 |
| 4,762,297 | 8/1988 | Milligan | 248/99 |
| 4,881,706 | 11/1989 | Sedlik | 248/99 |
| 4,905,946 | 3/1990 | Wang | 248/170 |
| 4,915,330 | 4/1990 | Buckley | 248/99 |
| 4,974,799 | 12/1990 | Palmer | 248/95 |
| 4,984,759 | 1/1991 | Perlant | 248/99 |
| 5,012,994 | 5/1991 | Keefe | 248/99 |
| 5,018,691 | 5/1991 | King | 248/99 |
| 5,040,755 | 8/1991 | Dineen et al. | 248/99 |

*Primary Examiner*—Alvin C. Chin-Shue
*Assistant Examiner*—Derek J. Berger
*Attorney, Agent, or Firm*—Grace J. Fishel

[57] ABSTRACT

A plastic bag holder for bags with integral loop handles. The holder has planar U-shaped arms including a pair of opposing legs mounted on one side of a bite and with a U-shaped lug formed on the opposite side of the bite. Male and female mating members pivotally hold one leg of each planar U-shaped arm and mount the arms on a planar mounting panel. The male and female mating members hold the legs spaced apart from each other and in at least one fixed angular position with respect to the mounting panel.

1 Claim, 2 Drawing Sheets

PLASTIC BAG HOLDER

BACKGROUND OF THE INVENTION

1. Field of the Invention

The present invention relates to a foldable rack for holding plastic bags of the kind having integral loop handles.

2. Brief Description of the Prior Art

In recent years, merchants have changed from paper bags for customers' purchases to thin plastic bags with integral loop handles. Merchants have been motivated to make this change because plastic bags are cheaper and take less space to store. They are also recyclable.

The plastic bags used by merchants are tough and suitable for reuse by the customer if there was a good way to hold them upright and open. A number of plastic bag holders addressed at this problem have been patented but none, insofar as known, are in common use.

A commercially successful plastic bag holder must be inexpensive to make and easy to install. It should also package flat so that it does not take up much retail shelf space or be difficult to ship. A good plastic bag holder should attach to the inside of a cabinet door, such as at a kitchen sink, in a manner that does not interfere with opening and closing the door.

SUMMARY OF THE INVENTION

In view of the above, it is an object of the present invention to provide a plastic bag holder that will hold a plastic bag by its loop handle upright and open. It is another object to provide a plastic bag holder that is inexpensive to make and easy to install. It is also an object to provide a plastic bag holder that folds flat and, in a preferred form when installed on the inside of a cabinet door, does not interfere with opening and closing the door. Other objects and features of the invention will be in part apparent and in part pointed out hereinafter.

In accordance with the invention, a foldable plastic bag holder for bags of the kind having integral loop handles has first and second planar arms and an elongated mounting panel. The planar arms are U-shaped with a pair of opposing legs mounted on one side of a bight and with a U-shaped lug formed on the opposite side of the bight. The lug also has a smaller bight with a length so that the loop handle of the bag is substantially extended when the handle is placed over the lug. The mounting panel has means for pivotally holding one leg of each planar arm in spaced apart relationship to each other. The means also holds the legs in at least one fixed angular relationship with respect to the mounting panel. The means for pivotally holding the legs are male and female mating members.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
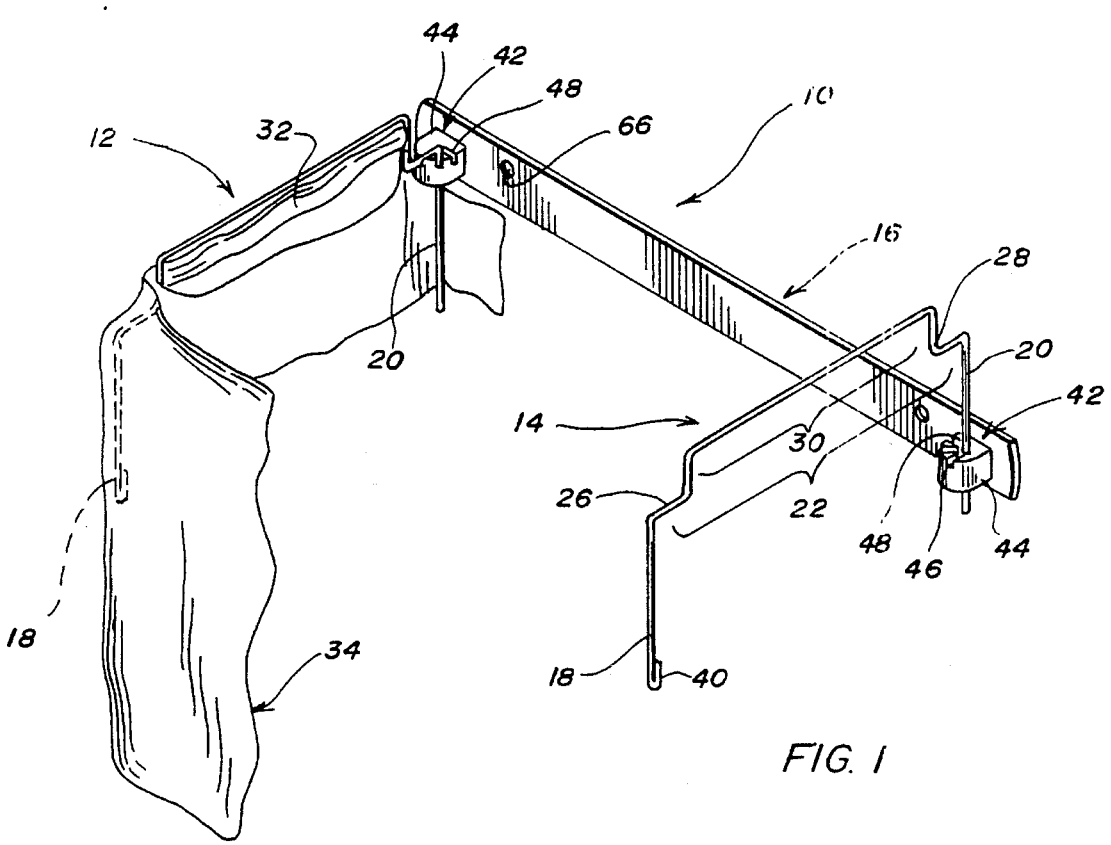
FIG. 1 is a perspective view of a plastic bag holder in accordance with the present invention.

Referring to the drawings more particularly by reference character, reference numeral 10 refers to a plastic bag holder in accordance with the present invention. Holder 10 in major part includes first and second planar arms 12, 14 and an elongated mounting panel 16.

As shown in the drawings, each of planar arms 12, 14 is U-shaped with a pair of opposing legs 18, 20 mounted at opposite ends and on one side of a bight 22. Legs 18, 20 are preferably parallel to each other and at least leg 20 is generally normal to bight 22 which is preferably flat. A U-shaped lug 24 is formed on the opposite side of bight 22. Lug 24 includes a pair of opposing legs 26, 28 and a bight 30. Legs 26, 28 are parallel to each other or angled convergently towards bight 22 to prevent a loop handle 32 of a bag 34 from slipping off. Bight 30 of lug 24 has a length so that loop handle 32 is substantially extended when the handle is placed over the lug. In the drawings, a single piece of wire forms legs 18, 20 and bight 22 with lug 24 being integrally formed as part of bight 22 and with the remainder of bight 22 taking the form of short segments 36, 38 flanking lug 24. As a safety measure, leg 18 of each planar arm 12, 14 is bent back on itself, forming a closed hook 40.

Figure 3:
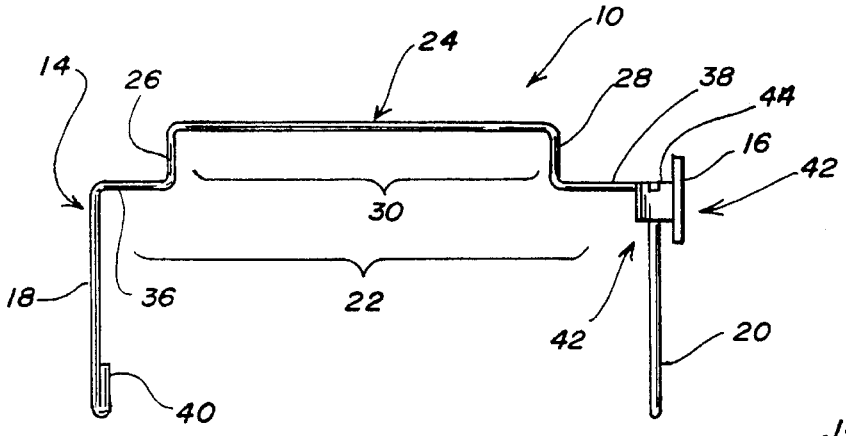
FIG. 3 is a side elevation of the plastic bag holder.

Mounting panel 16 has a means 42 for pivotally holding leg 20 of each planar arm 12, 14 in spaced apart and at least one fixed angular relationship with respect to said mounting panel. The spaced distance between arms 12, 14 is such that a bag is held open when loop handles 32 are placed over lugs 24. Various angular relationships are possible. For example, arms 12, 14 may be generally perpendicular to mounting panel 16 as best seen in FIG. 3. In other instances, it may be advantageous for arms 12, 14 to diverge outwardly from mounting panel 16 so as to give the open bag a trapezoidal form, maximizing the mouth of the open bag. When holder 10 is mounted on a cabinet door such as that of a kitchen sink, it may be advantageous for arms 12, 14 to converge outwardly from mounting panel 16 so that the holder does not interfere with the normal action of the door. It is also desirable that means 42 permit arms 12, 14 to fold flat against mounting means 42 for the purpose of folding flat in use or for packaging. In some instances, means 42 may be adjustable along mounting panel 16 (e.g., the mounting ears described below may slide or sections of the mounting panel may telescope) to adjust the distance between arms 14, 16 for use with different sized bags.

Figure 2:
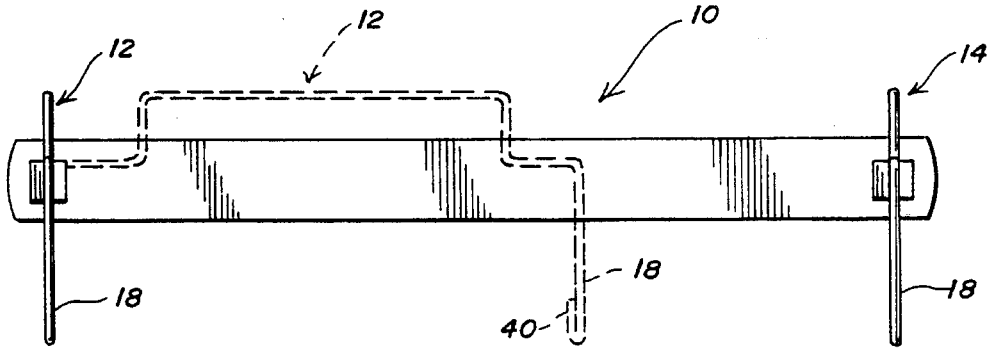
FIG. 2 is a front elevation of the plastic bag holder.

As shown in FIGS. 1–3, means 42 comprises a pair of mounting ears 44 into which legs 20 are journaled. A recess 46 is provided in an upper surface of mounting ears 44 for receipt of short segment 38. As will be readily appreciated, mounting ears 44 with recess 46 and legs 20 with segments 38 form male and female mating members that act as means 42 for pivotally holding one leg of each planar arm in spaced apart fixed angular relationship with respect to said mounting panel. When it is desirable to change the position of arms 12, 14, each leg 20 is lifted, unseating segment 38 from recess 46 so that the arms are free to rotate in ears 44. Segment 38 can then be reseated in a second recess 48, locking arms 12, 14 in selected second position.

Figure 4:
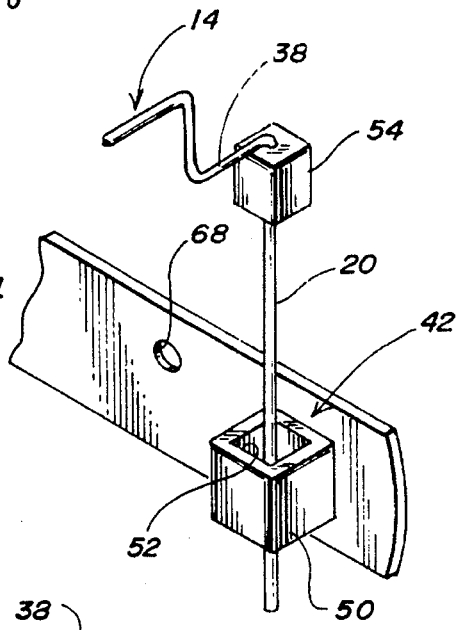
FIG. 4 is a perspective view of a portion of a second plastic bag holder in accordance with the present invention.
Figure 5:
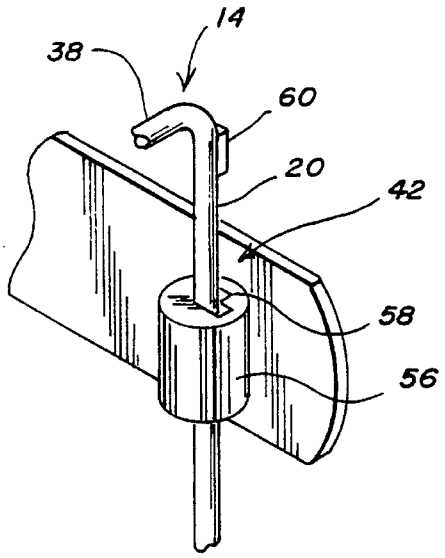
FIG. 5 is a perspective view of a portion of a third plastic bag holder in accordance with the present invention; and, FIG. 6 is a side elevation, partly in section, of a portion of a fourth plastic bag holder in accordance with the present invention.
Figure 6:
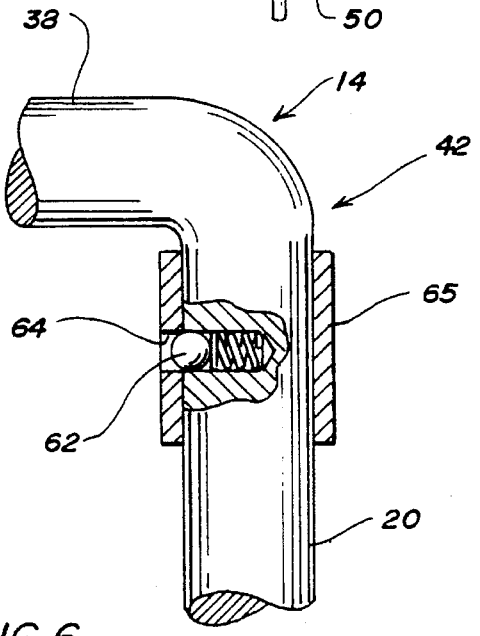

Other male and female mating members are shown in the drawings. Referring now to FIG. 4, means 42 comprises a pair of mounting ears 50 with a square aperture 52 into which is mated a block 54 attached to leg 20 near segment 38. When block 54 is seated in aperture 52, each of arms 12, 14 is held in fixed angular position. By lifting block 54 out of aperture and rotating it 90 degrees, arms 12, 14 may be secured in other angular position with respect to mounting panel 16. In FIG. 5, means 42 comprises a pair of mounting ears 56 with an aperture having one or more slots 58 into which is mated a key 60 formed on leg 20 near segment 38. Still other means 42 are shown in FIG. 6 wherein a spring loaded ball 62 in leg 20 is received in a recess 64 provided for that purpose in mounting ears 65. As will be readily understood, more than one recess may be provided for selected angular positioning of arms 12, 14 with respect to mounting panel 16.

In reference to U-shaped arms 12, 14, the term "wire" refers specifically to a steel member. It will be recognized that an equivalent wire member may be formed from other metals, as well as certain synthetic plastic materials that can be molded to have a "wire" form, and which have sufficient rigidity for the purposes to be served by the holder of this invention. Mounting panel 16 may be similarly inexpensively made of metal or plastic.

In use, holder 10 may be packaged unassembled or with arms 12, 14 journaled in the mounting ears and folded generally flat against mounting panel 16. A fastening means 66 such as wood screws (see FIG. 1) may be used to attach mounting panel 16 to the inside of a kitchen cabinet door or other suitable mounting surface. Apertures 68 or the like (see FIG. 4) may be provided in mounting panel 16 to facilitate this operation. Other fastening means may be used, for example a sheet metal screw threadedly inserted in a metal door, or a machine screw and cooperating nut may be used. Mounting panel 16 may also be attached with adhesives, etc.

After holder 10 is mounted, arms 12, 14 are folded outwardly and bag 34 hung by its loop handles 32. As shown in FIG. 1, legs 18, 20 are on the inside of bag 34 and keep the mouth of the bag stretched open so that the bag is easier to hit with trash and so that the trash does not slip between the bag and mounting panel 16. If desired, arms 12, 14 may be folded against mounting panel 16 while bag 34 is hung by its loop handles 32. This is particularly desirable when there is little space between the inside of a cabinet door and the bowl of the sink or the like so that the door may be closed when the bag is not presently needed. In addition, a plurality of bags may be nested with their loop handles 32 over lugs 24 with the innermost one being the current trash receptacle and holder 10 serving as a storage place for extra bags.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A foldable plastic bag holder, said holder having first and second planar arms and an elongated mounting panel, said planar arms being U-shaped with first and second opposing legs mounted on one side of a bight, said bight comprising a U-shaped lug opposite the legs and flanked by segments, said legs being substantially normal to the segments, said lug being U-shaped with a bight, said bight having a length so that a loop handle of a bag having integral loop handles is substantially extended when the handle is placed over the lug, and said mounting panel having first and second mounting ears on opposite ends of the mounting panel into each of which one leg of one of the planar arms is journaled, each of said mounting ears having a first recess in an upper surface for receipt of one of the segments flanking the leg journaled in the ear to position the planar arm generally normal to the mounting panel and a second recess opposing the second recess in the other mounting ear for receipt of said segment to position the planar arm folder against and generally parallel to the mounting panel, said planar arm held in said first and second recesses by gravity.

* * * * *